United States Patent [101]

Ellen

[11] 4,052,834

[45] Oct. 11, 1977

[54] METHOD OF ERECTING A ROOF STRUCTURE

[76] Inventor: Peter Edington Ellen, 16 Cornwall Avenue, Turramurra, 2074 Sydney, Australia

[21] Appl. No.: 656,950

[22] Filed: Feb. 10, 1976

[30] Foreign Application Priority Data

Feb. 13, 1975 Australia ..... 0598/75

[51] Int. Cl.[2] ..... E04B 1/35

[52] U.S. Cl. ..... 52/741; 52/222; 52/223 R; 52/226; 52/640; 52/644

[58] Field of Search ..... 52/690, 691, 692, 693, 52/223 R, 227, 225, 741, 639, 640, 641, 643, 644, 226, 228, 229, 74, 222

[56] References Cited

U.S. PATENT DOCUMENTS

| | | | |
|---|---|---|---|
| 1,554,061 | 9/1925 | Wylie | 52/644 X |
| 2,333,136 | 11/1943 | Wolfard | 52/640 |
| 2,525,974 | 10/1950 | Taggart | 52/644 X |
| 2,693,195 | 11/1954 | Frieder et al. | 52/644 |
| 2,793,720 | 5/1957 | Hawes | 52/223 R |
| 2,988,810 | 6/1961 | Wilken | 52/643 X |
| 3,010,257 | 11/1961 | Naillon | 52/225 |
| 3,057,119 | 10/1962 | Kessler | 52/741 |
| 3,106,772 | 10/1963 | Holcombe | 52/2 X |
| 3,778,946 | 12/1973 | Wood et al. | 52/741 X |
| 3,849,953 | 11/1974 | Cohen | 52/86 |

FOREIGN PATENT DOCUMENTS

| | | | |
|---|---|---|---|
| 194,115 | 12/1957 | Austria | 52/639 |
| 589,547 | 12/1959 | Canada | 52/228 |
| 781,206 | 5/1935 | France | 52/223 R |
| 833,212 | 10/1938 | France | 52/644 |

*Primary Examiner*—Leslie Braun
*Attorney, Agent, or Firm*—Michael J. Striker

[57] ABSTRACT

A roof structure made up by a plurality of truss members interconnected by purlins which carry sheet metal roofing material. The truss members are made up of a top compression member which is preferably a tube and a bottom tension tube the members being connected together by vertical tension struts and joined at their ends. The top compression member of each truss consists, before erection of a straight or partially curved member and the bottom tension tube of a downwardly bowed tube. The structure is given form and rigidity by passing high tension steel cables through the bottom tension tubes and, after the purlins and sheet metal roofing material have been attached, tensioning them to bring the top compression members to an upwardly curved configuration and the bottom tension tube to a straight or slightly upwardly bowed form.

2 Claims, 20 Drawing Figures

METHOD OF ERECTING A ROOF STRUCTURE

The present invention relates to a roof structure which is adapted for use in roofing large areas, as in farm buildings and factories, with a considerable economy of material.

The present invention consists in a roof structure consisting of a plurality of truss members interconnected by purlins, said purlins carrying a metal sheet covering material which is preferably corrugated, each truss member consisting of a top compression member preferably a tube and a bottom tension tube connected together by vertical tension struts, and joined at their ends, the top compression member consisting before erection of a straight or partially curved member and the bottom tension tube consisting before erection of a downwardly bowed tube having within it at least one high tension steel cable which has been tensioned until the bottom tension tube becomes straight or slightly upwardly bowed and the top compression member is brought to an upwardly curved configuration, the tensioned steel cable of the bottom tension tube being anchored at each end.

In order that the invention may be better understood and put into practice a preferred form thereof is hereinafter described, by way of example, with reference to the accompanying diagrammatic drawings in which:

FIG. 1 is a perspective view of a roof structure according to the invention, part of the roof sheet being broken away, FIG. 2 shows one half of a truss as initially manufactured, FIG. 2 *a* shows in greater detail the central part of the truss, FIG. 2*b* shows detail A of FIG. 2, FIG. 3 shows a truss arranged for attachment of the purlins, FIG. 4 shows the purlins and roof sheet attached, FIG. 5 shows the effect of passing a cable through the lower tension tube of the truss and tensioning it to make the tension tube substantially straight, FIG. 6 shows the completed truss with the tension tube slightly cambered, FIGS. 7*a* -7*c* illustrates the manner in which a building having a roof structure according to the invention can be erected, FIG. 8*a* and 8*b*, illustrate the erection of a slightly different form of structure, FIGS. 9*a* -9*c* illustrate the erection of a building using air bags, FIG. 10 illustrates the manner in which a sloping site may be accomodated, FIG. 11 illustrates the manner in which adjacent structures may be interconnected and, FIGS. 12 and 12*a* illustrate a variation in which two pairs of trusses are used in the roof structure.

In the construction, for example, of a farm building where it is desired to cover a large area with considerable economy of material the present invention may be effectively applied. In the building shown in FIG. 1 the roof structure is made up of two steel tubular trusses 11 which span the width of the building. Each truss 11 consists, before erection of a top compression member 12 which in this case consists a pair of straight lengths of steel tubing preferably galvanized and a bottom tension tube 13 which consists of a similar tubular member but which instead of being straight is bowed in a downward direction in relation to the normal attitude of the roof as illustrated in FIG. 3. The top compression tube 12 is made in two parts joined by a slip joint 14 and is connected to the bottom tension tube, also in two parts, the tubes being joined at 16 by a number of vertical struts 15. A high tensile steel cable is threaded through the bottom tension tube for subsequent tensioning.

FIG. 2 shows in more detail one half of a truss in the form in which it is initially fabricated this being also the form assumed by it after erection in a suitable jig. As may be seen from FIG. 2*b* the top compression member 12 consists of two rectangular secton steel tubes 12*a* and 12*b* welded to each side of the vertical struts 15 each of which has an upward extension 16 having holes 17 by means of which a purlin 18 (see FIG. 1) is bolted to it. The bottom tension tube 13 consists of a single steel tubular member of rectangular cross section the lower ends of the compression struts 15 are welded. During welding the half turns is held in the configuration shown by the jig. However on removal from the jig the heavier top compression tube asserts itself and straightens out causing the lower tension tube to assume an arcuate configuration.

Each truss is made up of two identical halves as shown in FIG. 2 which are joined in the middle in the manner shown in FIG. 2a, the top compression member being jointed by a sleeve 14 which simply slips over the ends of members 12. As will be seen from this Figure the plates 19 of the bottom tubes 13 are spaced apart and the members 12 are held in alignment by the sleeve 14. During erection the end of the truss are suitably supported. Two truss members are arranged side by side and purlines 18 are connected to them and roof sheeting for example corrugated iron 21 is applied as shown in FIG. 4.

At this stage a pair of trusses is joined by purlin 18 to which the roof covering 21 in the form of corrugated sheet steel or aluminium is fixed. The steel cables in the bottom tension tubes 12 of the pair of trusses are then tensioned until the bottom tension tube 13 is straight as in FIG. 5, tensioning is then continued until they are slightly upwardly bowed as shown in FIG. 6. The flanges 19 are then secured together by bolting. Simultaneously the top compression member 13 is brought to a curved configuration and with it the roof sheets 21. In this state the member 12 and the roof sheeting 21 are in compression and have a camber of between one in 15 and one in 30 preferably one in 25. The bottom tension tube 13 is upwardly bowed to tension the vertical struts 15 and has a camber of between 1 and 3% of the span. The ends of the tensioning cables are anchored and all thrusts of the cables travel through the curved membrane constituting the roof, the interaction of this curved membrane and the tension cables providing a stiffening effect. The cables are tensioned to about 25,000 lbs. and anchored to a suitable fitting 22 at each end of the truss. If desired they may be grouted to the tube.

The fitting 22 also serves as a means for the attachment of legs to each end of the truss. The legs are attached by means of a pair of bolts arranged so that initially each leg is connected by only one bolt so that it may be folded under the roof structure in the manner shown in FIG. 7*a*. As shown in FIG. 1 each leg 23 supports one end of a truss, adjacent legs being interconnected by cross bracing 24 and each being supported on a support 25. This can conveniently consist of a block of concrete set in the ground having an upwardly projecting pin that fits into the leg 23. Th size and depth of the concrete block is chosen to suite the ground conditions at the site of the building. The top of each leg 23 is anchored to the ground by means of a cable 26 attached to a suitable ground anchor 27. The anchors 27 must be sufficiently strong to hold down the building against strong wind loads both upward and lateral and must be such as to support a maximum tie down force in the cables 26 of 8,000 lbs.

FIGS. 7*a* to 7*c* illustrate how a building employing a roof structure according to the invention may be erected. As shown in FIG. 7*a* the roof structure is assembled on the ground with the legs 23 folded underneath the structure. The structure is erected by lifting one corner by means of a crane thus bringing one pair of legs to a vertical position and engaging therewith supports 25. The cable 26 is then attached to the anchor 27. Thereafter the other legs 23 are erected in a similar manner to provide a structure as shown in FIG. 1.

FIGS. 8*a* and 8*b* illustrate a building having a similar roof structure but in this case the legs 23*a* are of a somewhat different form each consisting of a triangular structure having a base bearing on the ground and anchored to it, the width of the base of each leg being such as to avoid the necessity for the use of bracing cables 26.

FIGS. 9*a*, 9*b* and 9*c* illustrate the erection of a building similar to that shown in FIG. 1 by the use of air bags 28. As can be seen in FIG. 9*a* a pair of deflated air bags are inserted under the roof structure. One of these is then inflated and the legs on that side of the structure engaged with their supports. Thereafter the other bag is inflated to complete the erection of the structure. In all cases after completion of the erection of the structure the upper ends of the legs are attached to the trusses by the means of additional bolts to prevent further movement at the connection between the legs and the trusses.

Figure 1:
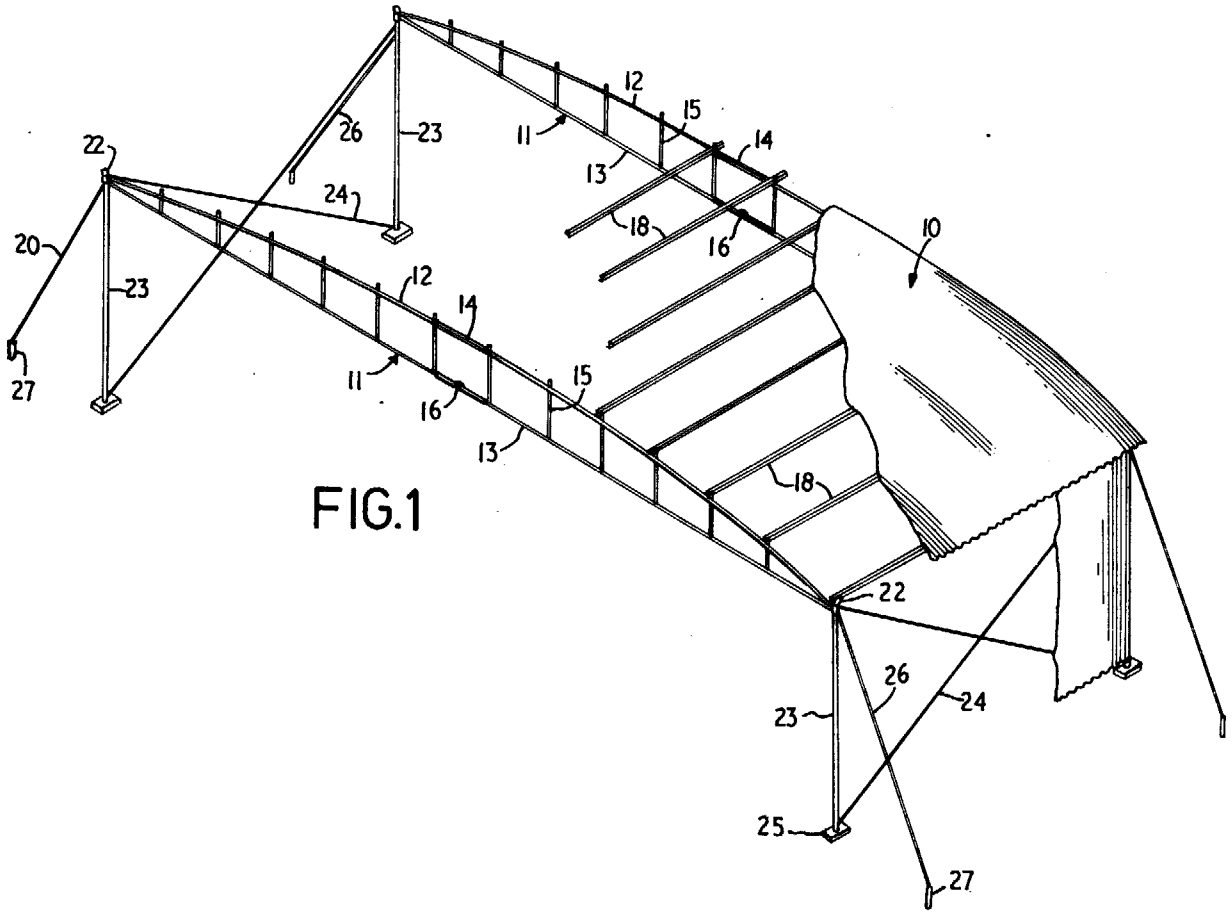
Figure 2:
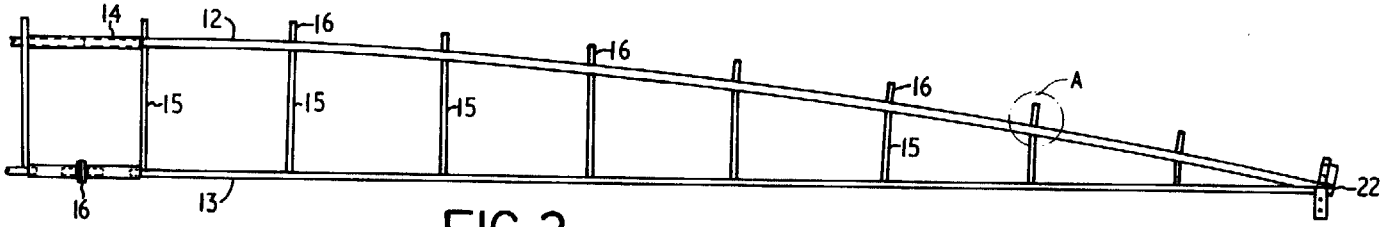
Figure 2B:
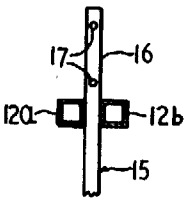
Figure 2A:
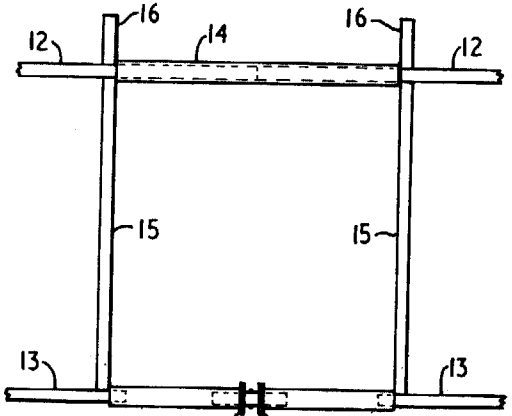
Figure 3:
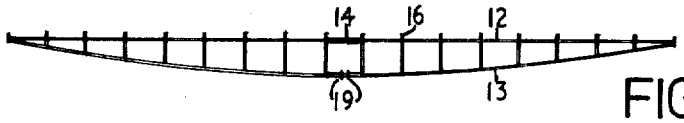
Figure 4:
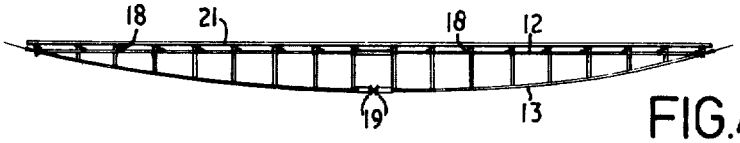
Figure 5:
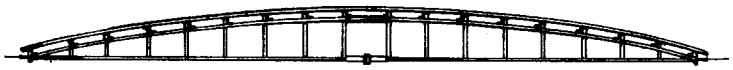
Figure 6:
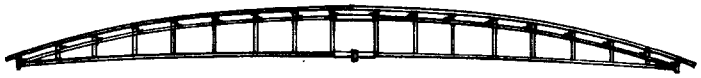
Figure 7A:
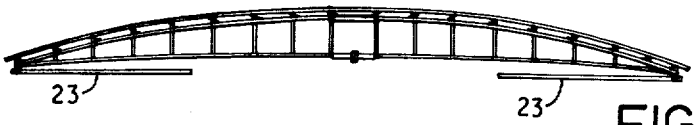
Figure 7B:
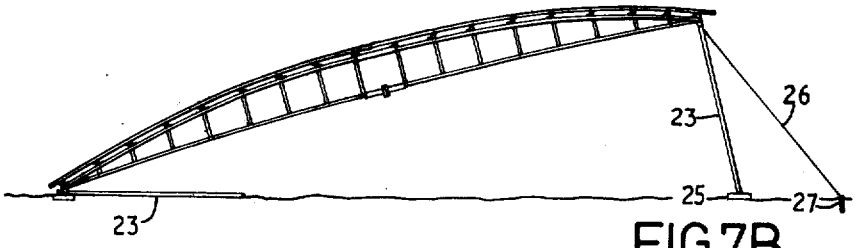
Figure 7C:
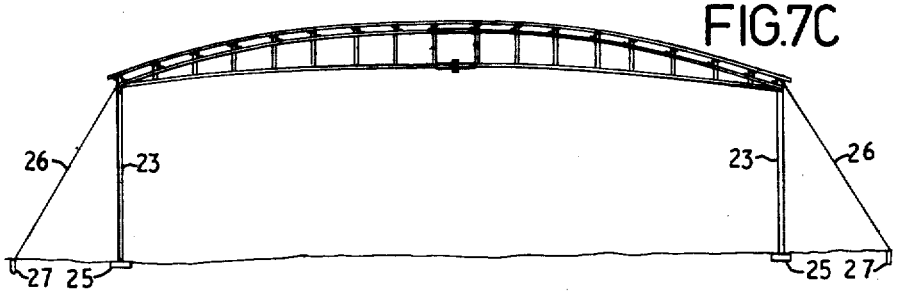
Figure 8A:
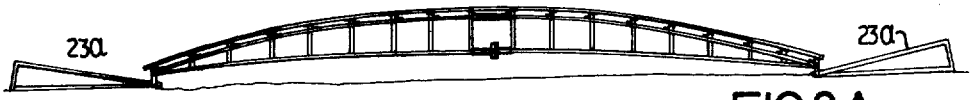
Figure 8B:
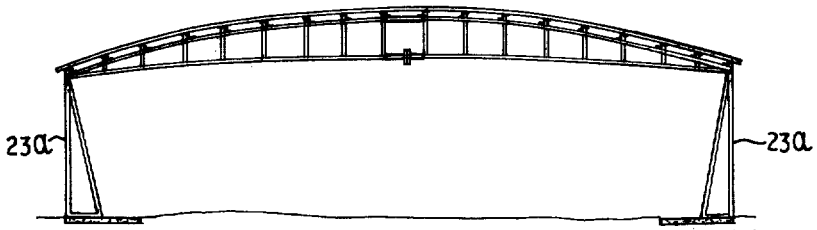
Figure 9A:
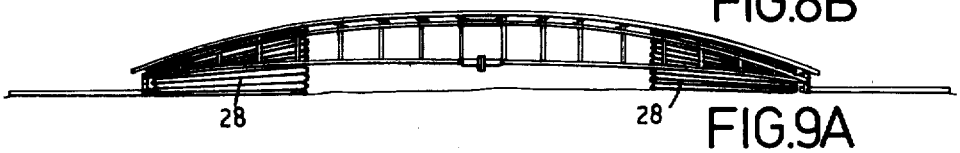
Figure 9B:
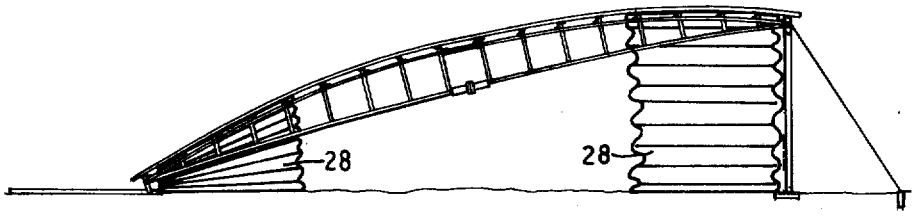
Figure 9C:
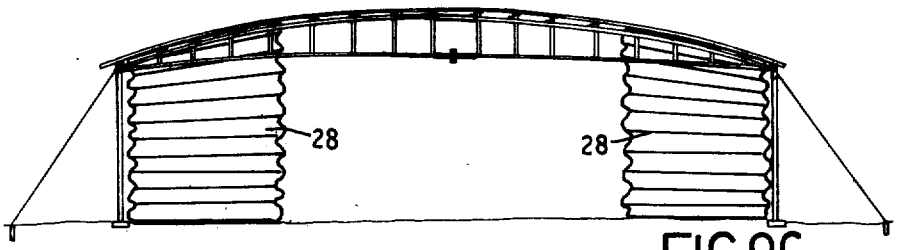
Figure 10:
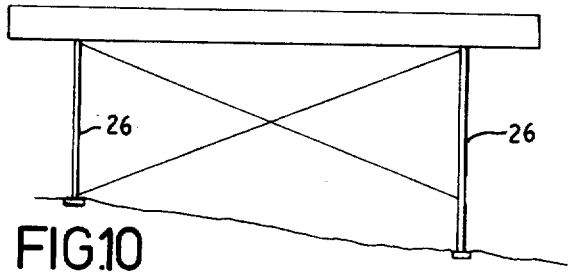
FIG. 10 illustrates the manner in which a sloping site may be accomodated by providing an extension to the legs 26 on the downhill side of the slope.
Figure 11:
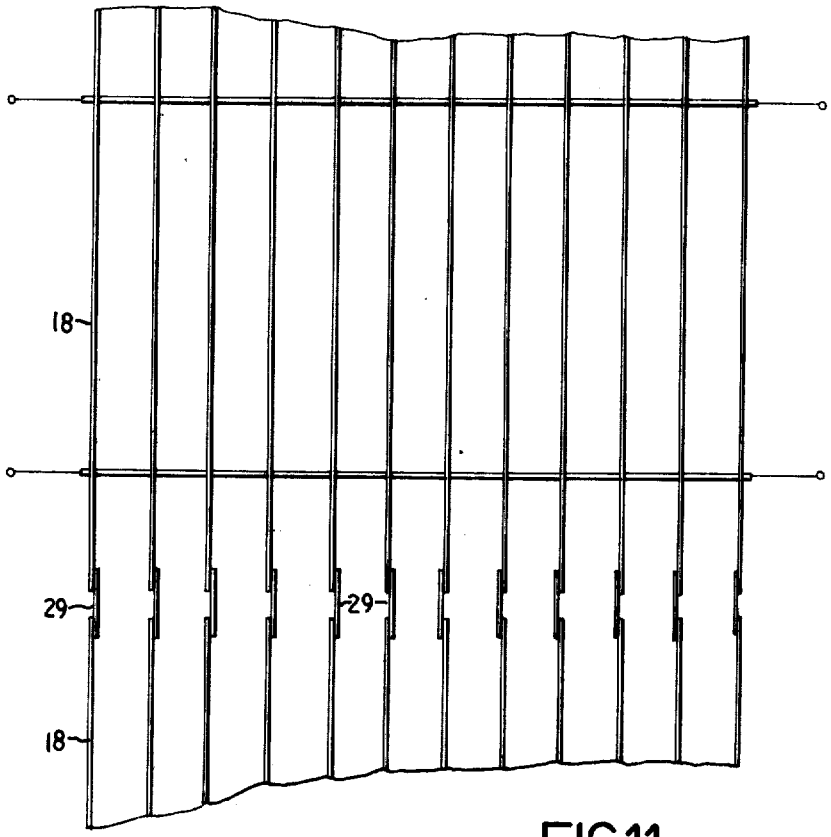
FIG. 11 shows a plan view of a building such as that shown in FIG. 1 together with a portion of another similar structure the two being joined side by side by means of lap splices 29 joining the ends of the purlin 18.
Figure 12:
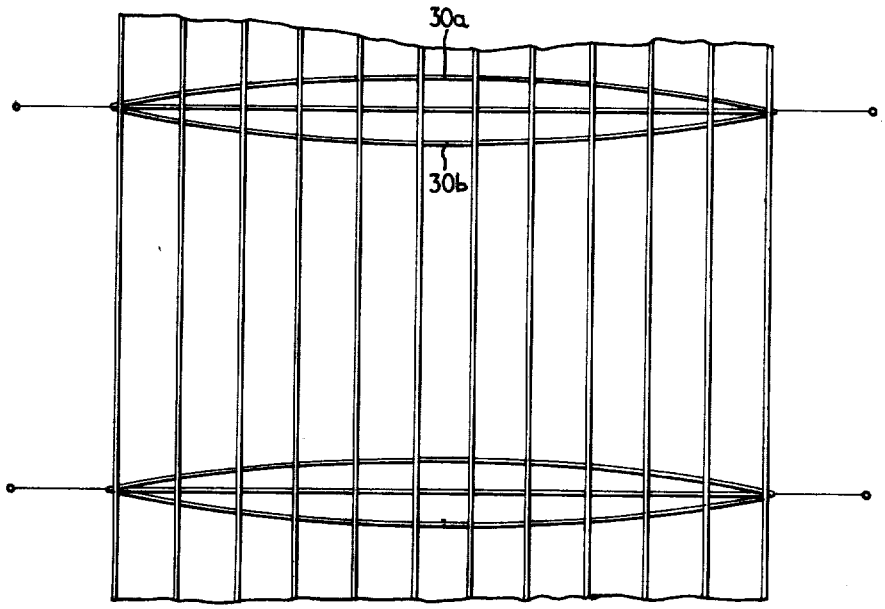
Figure 12A:
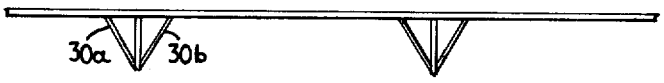

In areas of high wind forces the roof structure may be supported by pairs of trusses aranged in a V configuration so that each section of roof structure in this case incorporates four trusses. As is shown in FIGS. 12 and 12*a* a pair of trusses 30*a* and 30*b* is arranged side by side in the manner shown, the ends of the trusses being connected together at the edges of the roof structure.

The embodiments of the invention described above are given by way of example only to illustrate the application of the invention defined in the succeeding claims.

I claim:

1. A method of erecting a roof structure consisting of a. constructing at least two trusses each having a top compression member and a bottom tension tube connected together by vertical tension struts and joined at their ends, the top compression member being substantially straight and the bottom compression tube being downwardly bowed, b. interconnecting said struts by means of purlins connected thereto, c. applying a sheet metal covering material to said purlins, d. threading high tension steel cable through the bottom tension tubes, e. tensioning said cables to bring the structure to a configuration in which said top compression members and the covering are upwardly bowed and the bottom tension tubes are substantially straight or slightly upwardly bowed, f. anchoring the ends of said cables at the ends of said bottom tension tubes.

2. A method as claimed in claim 1 including the additional steps of constructing said trusses in two parts and joining them at the centerline of the truss.

* * * * *